United States Patent [19]

Wirz et al.

[11] Patent Number: 5,048,769

[45] Date of Patent: Sep. 17, 1991

[54] TRAVERSE MECHANISM

[75] Inventors: Armin Wirz, Ossingen; Hansueli Maier; Adolf Flueli, both of Winterthur, all of Switzerland

[73] Assignee: Rieter Machine Works Ltd., Winterthur, Switzerland

[21] Appl. No.: 610,347

[22] Filed: Nov. 5, 1990

Related U.S. Application Data

[63] Continuation of Ser. No. 525,305, May 17, 1990, abandoned, which is a continuation of Ser. No. 323,113, Mar. 13, 1989, abandoned, which is a continuation of Ser. No. 126,763, Nov. 30, 1987, abandoned.

[30] Foreign Application Priority Data

Dec. 2, 1986 [CH] Switzerland ..... 793/86

[51] Int. Cl.[5] ..... B65H 54/28

[52] U.S. Cl. ..... 242/43 R; 242/18 R; 242/158.3

[58] Field of Search ..... 242/43 R, 43 A, 43.1, 242/43.2, 158 R, 158 B, 158 F, 158.1, 158.2, 158.3, 158.4 R, 158.4 A, 158.5, 18 R, 18 A, 25 R, 25 A, 35.5 R, 35.5 A

[56] References Cited

U.S. PATENT DOCUMENTS

| | | | |
|---|---|---|---|
| 2,714,998 | 8/1955 | Guilbert | 242/158 |
| 3,784,126 | 1/1974 | Petry | 242/158.3 |
| 3,792,819 | 2/1974 | Schippers | 242/158.3 X |
| 3,817,465 | 6/1974 | Miller | 242/43 R |
| 3,908,919 | 9/1975 | Hermanns | 242/158.3 X |
| 3,933,321 | 1/1976 | Kawauchi et al. | 242/158.3 X |
| 4,044,961 | 8/1977 | Luz | 242/43 R X |
| 4,664,325 | 5/1987 | Pepe | 242/25 A |
| 4,762,284 | 8/1988 | Flueli et al. | 242/18 A |

FOREIGN PATENT DOCUMENTS

| | | |
|---|---|---|
| 2206264 | 6/1974 | France . |
| 2379464 | 9/1978 | France . |
| 1304609 | 1/1973 | United Kingdom . |

*Primary Examiner*—Stanley N. Gilreath
*Attorney, Agent, or Firm*—Kenyon & Kenyon

[57] ABSTRACT

A replaceable traverse module for a winder for winding endless filaments comprises a housing resting on a support element provided in the machine. The housing and the element have interengaging parts to form a guide for the module during insertion onto the machine, and which also cooperate to hold the module in a predetermined position relative to the threadline.

23 Claims, 4 Drawing Sheets

TRAVERSE MECHANISM

Figure 1:
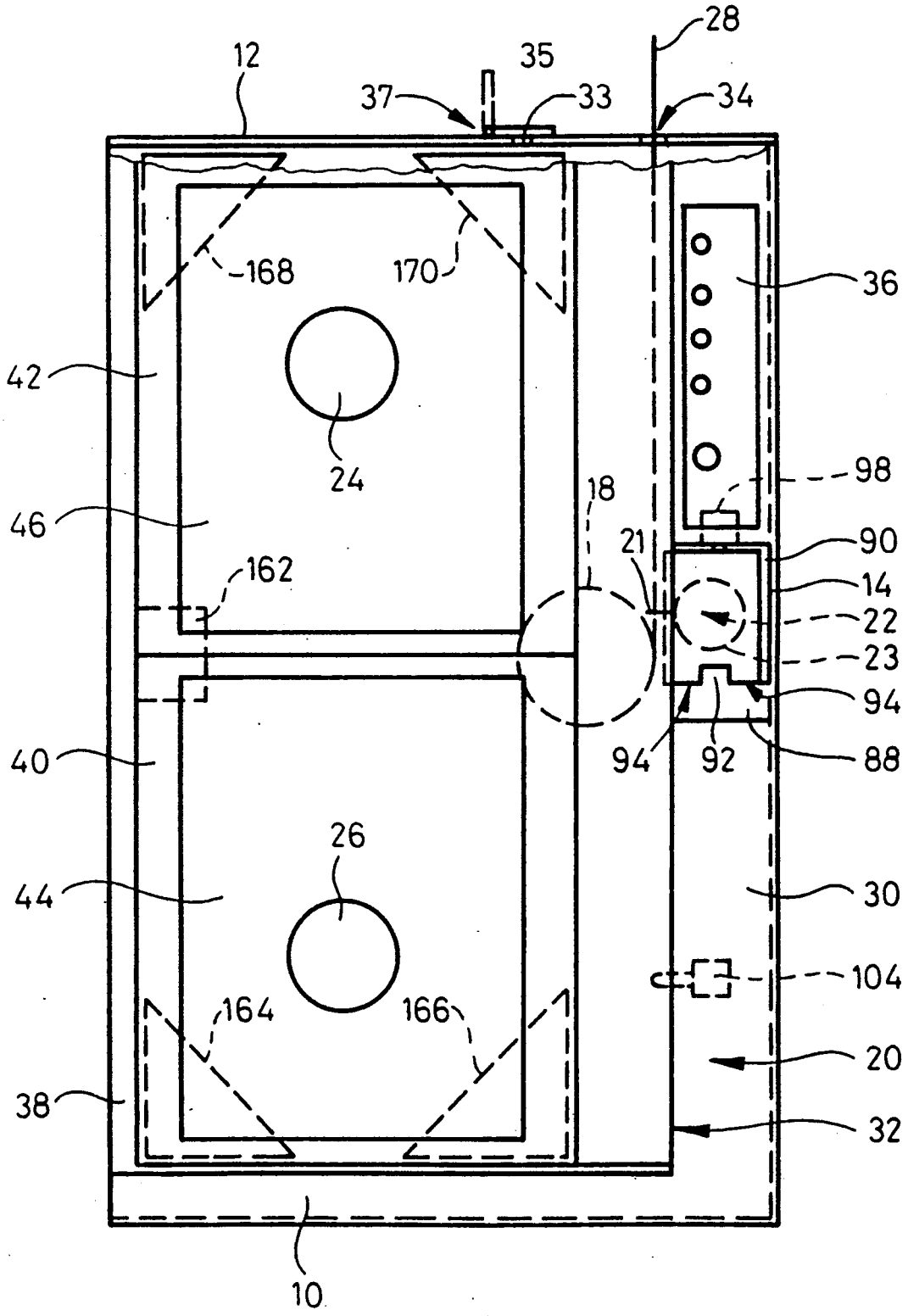

This application is a continuation of application Ser. No. 07/525,305, filed May 17, 1990, now abandoned, which is a continuation of application Ser. No. 07/323,113, filed Mar. 13, 1989, now abandoned, which is a continuation of application Ser. No. 07/126,763, filed Nov. 30, 1987, now abandoned.

This invention relates to a traverse mechanism for a winder for synthetic endless filament yarns.

STATE OF THE ART

Traverse mechanism are used in winders to move the thread to be wound back and forth in the axial direction of the package during package build. The device is normally secured to the machine frame as a replaceable unit. The unit comprises a carrier (normally a housing), the traverse device proper and drive transfer elements to transfer drive forces from a motor provided in the machine to the traverse device.

The currently conventional traverse device comprises a grooved roll and a thread guide which engages in the roller groove by way of a slider shoe. Examples of this design can be seen in U.S. Pat. Nos. 3,664,596 and 3,934,831. Recently, alternative designs in the form of so-called rotor traverse devices, belt mechanisms and others have been put forward, e.g. as seen in DOS 3516475 and DAS 1535091.

The present invention can be used with traverse mechanisms of all these types.

In a winder for endless filaments the packages are built up on a rotatable, cantilever mounted chuck. The traverse mechanism extends parallel to the chuck and over at least the length of the chuck on which packages are built in use. The carrier of the mechanism is therefore normally secured at one end to the machine frame. Such an arrangement is shown and described for example in British Patent Specification 1304609, where the various elements are only schematically indicated. In the installation described in this GB Patent, many filament yarns are wound up on respective individual chucks. Each chuck, and hence its corresponding traverse mechanism, is relatively short. Today, much longer chucks are in use, and mostly several packages are built simultaneously on a single chuck, e.g. up to eight. The traverse mechanisms must be designed correspondingly long, the number of individual traverse devices in each mechanism corresponding to the number of threads to be wound on the chuck.

With such long mechanisms in an installation of the type described in the GB Patent, it is clearly difficult to release a mounting between the carrier (housing) of the mechanism and the machine frame without having to dismantle other parts of the installation.

Not all winders for endless filaments are assembled to an installation of the above-mentioned type. Many machines are used in individual spinning positions, where access to the machine parts is relatively easy. In U.S. application Ser. No. 879,292 (filed June 27, 1986, now U.S. Pat. No. 4,762,284) it is suggested, however, that even individual machines should be provided with a "complete enclosure", which can of course hamper access to the individual components. The manipulation of a mounting at the inner end (i.e. the end adjacent the machine frame) of a traverse device can then present significant difficulties. With increasing length of the mechanism it is also undesirable to support the whole weight merely by a mounting at the inner end.

It is the object of this invention to avoid such problems.

A traverse mechanism according to the invention comprises, as in the current forms of mechanism, a carrier portion, at least one traverse device supported by the carrier in a predetermined arrangement, and drive elements for the traverse device. The carrier advantageously has a length corresponding to at least the length of the winding region of the winder.

The new traverse mechanism is characterised by means cooperating with corresponding means in the machine during assembly of the mechanism in the winder to perform at least one, and preferably all, of the following three functions:

1. to support the carrier at least at two locations spaced in the longitudinal direction,
2. to position the carrier in a predetermined operating position relative to the machine without securement at the inner end of the mechanism, and
3. to guide the mechanism during assembly in or removal from the machine.

These functions serve the following purposes:

1. Support of the carrier at least at two locations spaced along the length of the mechanism increases the effective stiffness of the mechanism in its longitudinal direction, which is a significant advantage as such mechanisms become steadily longer. Advantageously, the carrier is supported over its whole length, or at least at both ends. An overhang is however acceptable insofar as the carrier itself is sufficiently rigid to resist the weight supported thereby without unacceptable distortion. The means for this purpose can comprise a support surface provided on the carrier engaging a corresponding surface in the machine after assembly.

2. Positioning without securing at the inner end enables assembly in the machine, or removal therefrom, without access to the inner end of the mechanism; this also represents a great advantage with long mechanisms and cramped spaces. The alternative solution—a positioning securing device at the inner end operable from the outer end—would certainly be difficult to realise in practice without prejudicing the required precision of location relative to the other machine elements. The means for this purpose can comprise at least one abutment surface provided on the carrier to engage a surface provided in the machine after assembly.

3. Guidance of the mechanism during assembly in or removal from the machine ensures a predetermined mode of insertion, so that the mechanism can be inserted from a predetermined position (preferably at the front face of the machine) without hindrance from other machine parts. Preferably, insertion is performed by moving the mechanism in its own longitudinal direction. The guidance should be such that the mechanism is guided into the predetermined operating position in the machine. The means for this purpose can comprise a portion of the carrier which runs on a predetermined guidance track in the machine during assembly or disassembly, e.g. the carrier and the machine can be provided with interengaging parts so that the parts are free to perform only limited movements relative to each other after they have been engaged.

Normally, the drive for the traverse device must be transmitted to the traverse mechanism from a drive source provided in the machine. For this purpose the mechanism can be provided with one element of an automatically engaging clutch.

Preferably, the new traverse mechanism is also provided with manually engageable locking means to hold the mechanism in the operating position. In the event the machine is provided with a complete enclosure, the arrangement can be so selected that the traverse mechanism is removable from the machine only after opening of the door of the machine.

Control connections can be so arranged that the machine can not be set in operation until a traverse mechanism has been located in the operating position. Correspondingly, the arrangement can be such that the traverse mechanism can not be removed from the machine until the latter has reached a predetermined condition (standstill).

Figure 2:
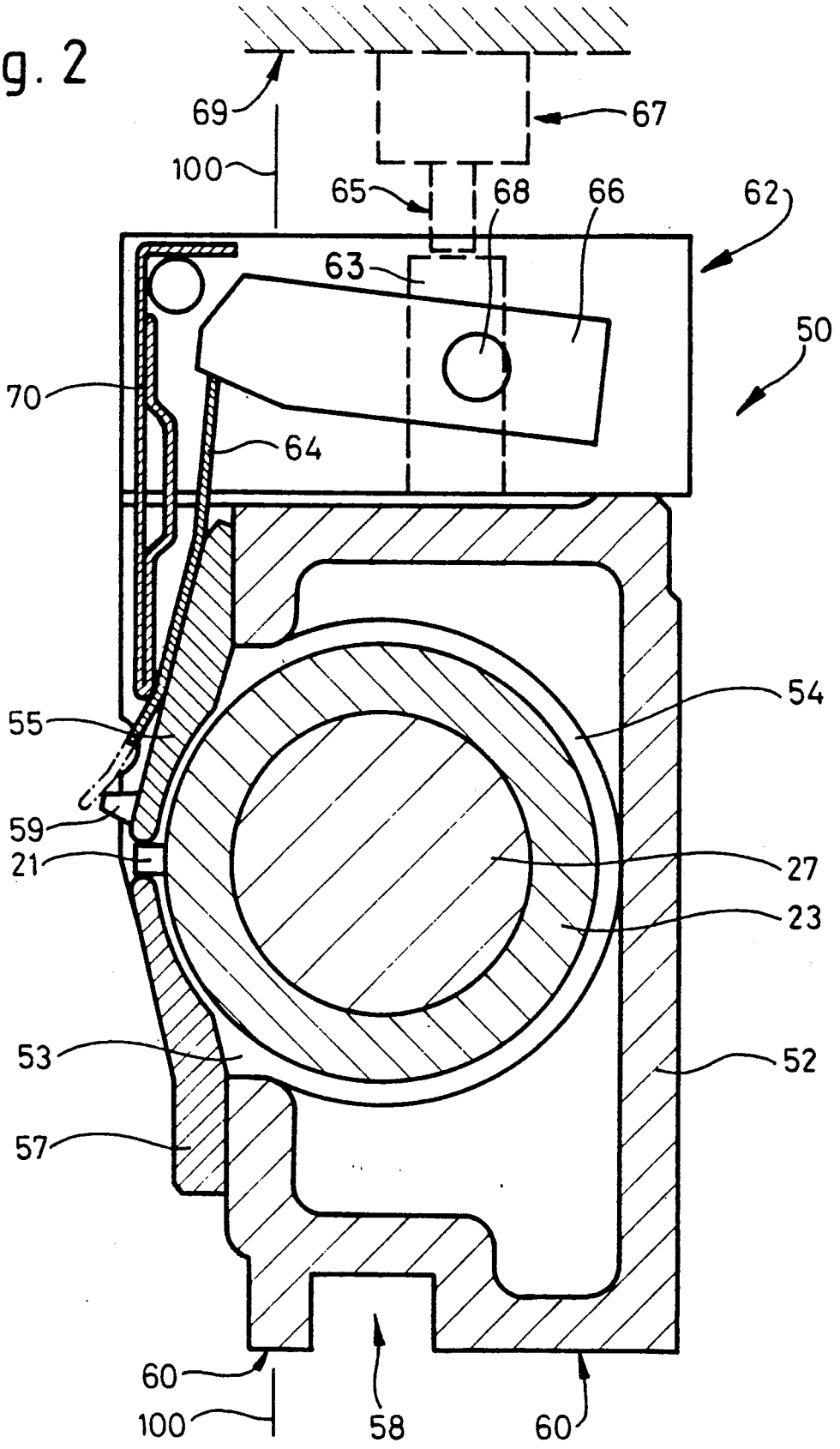
Figure 3:
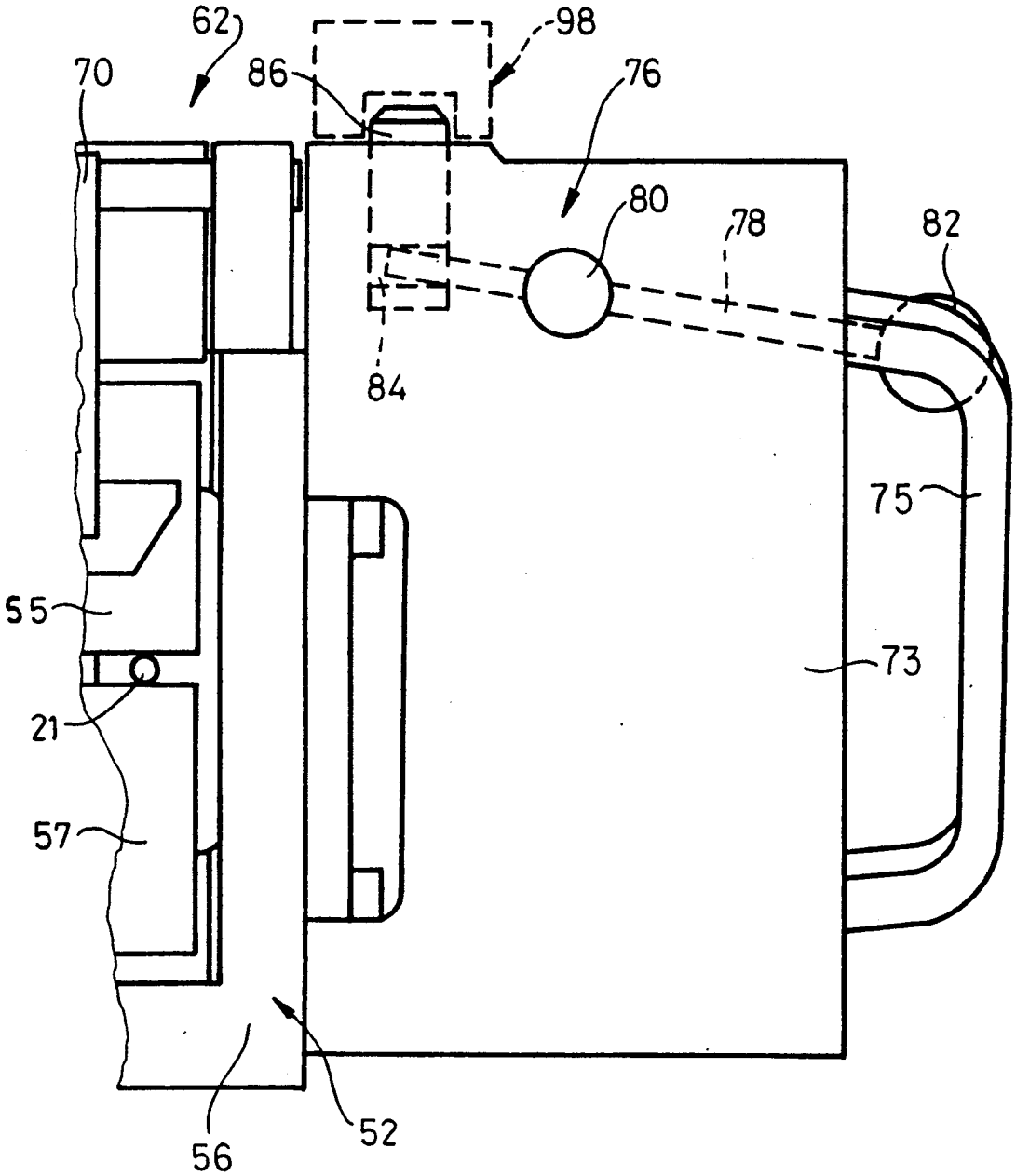
Figure 4:
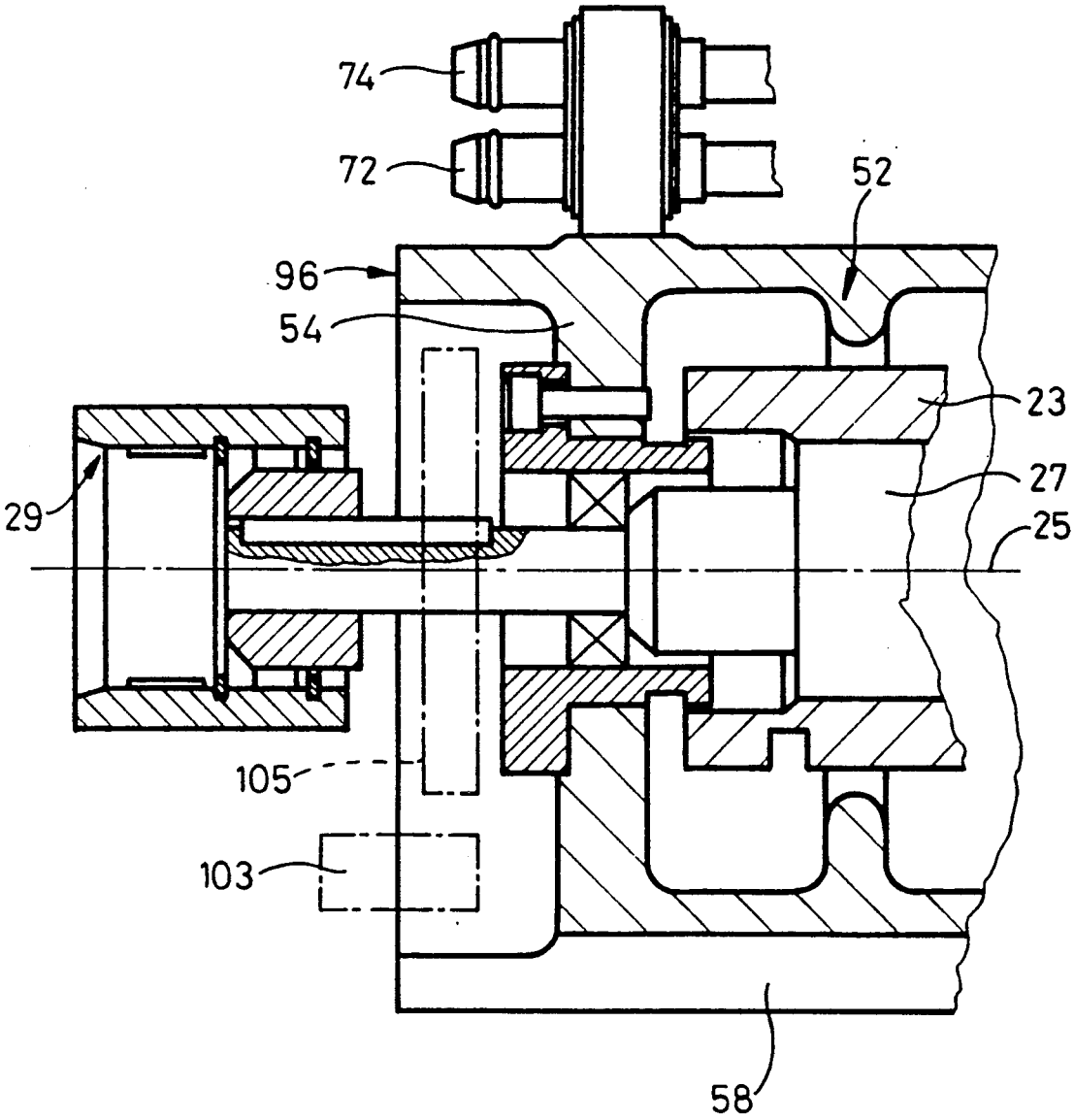

By way of example, one embodiment of the invention will now be described with reference to the accompanying drawings, in which:

FIG. 1 shows a front view of a fully enclosed winder with a schematic indication of a modification according to the present invention, FIG. 2 shows a section through a practical embodiment of the modification indicated in FIG. 1, FIG. 3 shows a side view of the front end of the traverse mechanism of FIG. 2 and FIG. 4 shows a side view of the rear end of the same mechanism.

FIG. 1 represents substantially a copy of FIG. 10 of U.S. patent application Ser. No. 879,292. The Figure has been changed only in respect of the traverse mechanism 22 as will be subsequently described. First, the other parts of the illustrated machine will be described in order to show the "background" to the developments of the present invention. The usage of reference numerals in FIG. 1. corresponds to the usage in FIG. 10 of the co-pending application.

The illustrated machine comprises a housing, which cannot be seen in the figure because it is directly behind the illustrated parts. In front of the housing the machine has a "working zone" where delivered threads are formed into packages. A contact roll 18 (drive roll or tacho-roll) and two chucks 24,26 project from the housing into the working zone. The housing itself contains support and drive components for these parts 18,24,26. This general arrangement is described in EU PS No. 73930 and further developments can be found in U.S. patent application Ser. No. 941,418, filed Dec. 15, 1986, now U.S. Pat. No. 4,741,485.

Preferably, the working zone is provided with a full enclosure; in FIG. 1, only the baseplate 10, a hood 12, a side wall 14 and a front wall 20 are schematically indicated. The front wall 20 consists of a fixed part 30 and a door assembly 32. The latter is mounted on the left-hand side wall (not shown) of the enclosure by hinges (not shown) at its left-hand edge. The assembly can be swung forwardly about a vertical pivot axis to give free access to the operating zone. Normally, however, it is held in a closed position in the front wall 20 by a lock 104.

The door assembly 32 comprises a frame 38, a lower doffing door 40 and an upper doffing door 42. These doffing doors are vertically movable in the frame 38 as described in detail in U.S. Ser. No. 941,418. When the lower doffing door 40 is moved upwardly, thread packages can be removed from the lower chuck 26 and replaced by empty tubes. Similarly, thread packages from the upper chuck 24 can be replaced by empty tubes when the upper doffing door 42 is moved upwardly. The reference numerals 44 and 46 indicate respective glass screens which enable visual monitoring of the condition of the working zone. Numeral 28 indicates the thread path through a slot 34 in the hood 12. During a threading phase, the threads to be wound runout of the machine through a further slot 33 in the hood 12 until they are taken up by one of the chucks 24,26. A cover plate 35 for this second slot 33 is then pivoted around a pivot axis 37 into a vertical position (indicated in dotted lines) to open the slot. During normal opoeration slot 33 is covered by the plate 35 (full line position).

Reference numerals 162,164,166,168,170 indicate various ducts which extend from the non-illustrated housing into the working zone. Various leads extend through the duct 162 to the door assembly 32. The ducts 164,166 serve to feed the working zone with cooling air which flows out again via ducts 168,170. Individual winders of this type can also be airconditioned individually.

The previously mentioned thread path 28 extends from the slot 34 around the contact roll 18 to a winding region described in EU PS 73930 and U.S. Ser. No. 941,418 but not shown in FIG. 1 since it is of no significance in relation to this invention. Since FIG. 1 represents a front view only one threadline 28 can be seen, although a plurality of threads can be processed simultaneously at predetermined spacings along the roll 18.

For the sake of simplicity, only one thread will be referred to in the following description. The description is however valid for all simultaneously processed threads.

The traverse mechanism 22 effects a back and forth movement of the thread in the axial direction of the roll 18 just before the thread reaches the roll. FIG. 1 indicates a conventional traverse mechanism with a grooved roll 23 and a thread guide 21 moved by the grooved roll. This traverse mechanism extends from the non-illustrated housing parallel to the roll 18 in the working zone of the machine, and its front end lies in the part 30 of the front wall 20 below the control panel 36. The arrangement of this traverse mechanism in the machine as a whole is the subject of the present invention and will now be described with reference to the other figures.

The complete mechanism is indicated in FIG. 2 by the reference numeral 50. This mechanism comprises a carrier 52 formed as a casting and extending over the complete length of the working zone of the machine. A drive shaft 27 for the grooved roll 23 is supported for rotation about its own longitudinal axis 25 (FIG. 4) in a rear portion 54 and a front portion 56 (FIG. 3) of the carrier 52. On its underside the carrier 52 is provided with a groove 58 (FIGS. 2 and 4) opening outwardly. On both sides of this groove the carrier 52 presents an outwardly facing surface 60 (FIG. 2).

The carrier 52 is formed as the housing for the grooved roller, but has an opening 53 in its longitudinal side facing the working zone of the machine. This opening is for the greater part covered by two slats 55,57, while leaving a linear guide path free for the thread guide 21. Reference numeral 59 indicates a pin built into the upper slat 55 to push the thread into the guide 21 during a changeover.

On the upper side of the carrier 52 sits a unit 62 which comes into operation during threading up. This unit comprises a so-called threading plate 64 which is supported by a lever 66 for rotation about an axis 68.

The lever 66 is illustrated in an upper position which it takes up during normal operation and thereby holds the plate 64 in a withdrawn position. During threading up, the lever 66 can be swung downwardly (anticlockwise in FIG. 2) around the axis 68 to bring the plate 64 into a covering position indicated in dotted lines to prevent penetration of the thread into the thread guide. Before the thread is taken up by one of the chucks 24,26 the plate 64 is returned to its withdrawn position to release the thread for normal traverse.

The unit 62 comprises also a lifter plate 70. This plate is also pivotally supported (details omitted), so that it can be moved by clockwise rotation from a withdrawn position (shown in FIG. 2) into an operating position. The lifter plate is moved into this operating position during the changeover phase, i.e. while the thread is being transferred from one chuck to another, or during initial threading, to shift the thread into an oppositely disposed auxiliary thread guide (not shown). This function has been described in U.S. Pat. No. 3,920,193, and will therefore not be further explained here.

The rear end portion 54 of the support 52 carries automatically engaging connectors 72,74 by way of which the unit 62 can be supplied with pressure air. Further, the rotatable shaft 27 projects at the rear end of the traverse mechanism 50 beyond its bearing into the end portion 54 and carries at its rear end an internally toothed clutch element 29. The cooperation of the elements 29,72,74 with corresponding connector elements on the non-illustrated housing of the machine will be described subsequently.

An extension 73 (FIG. 3) is secured to the front end portion 56 of the support 52. This extension carries a grip 75 and a lock generally indicated by the numeral 76. The lock includes a lever 78 rotatably supported between its ends by a rotary shaft 80 in extension 73. At its front end, which projects from the extension 73, the lever 78 is provided with a knob 82. Its rear end projects into a transverse slot 84 in a pin 86. This pin is guided by suitable guide means (not shown) for movements at right angles to the length of the traverse mechanism, namely between an operating position (shown in FIG. 3) where the pin 86 projects from the top face of the extension 73, and a withdrawn position (not shown) where the pin 86 lies within the extension 73. A torsion spring (not shown) exerts a bias on the lever 78 to urge it clockwise against a non-illustrated abutment, the pin 86 being forced into its operating position. The pin 86 can be withdrawn in the anticlockwise direction by pivoting the lever 78 against this bias.

The machine (FIG. 1) is fitted with a beam 88 extending between the housing and the part 30 of the front wall 20 along the right hand side wall 14. The beam is rigid in its longitudinal direction and can advantageously be formed as an element of the machine frame. Above this beam 88, an opening 90 is left in the front wall 20 through which the traverse mechanism 50 can be inserted into the machine. The beam 88 has a key 92 extending over the whole length of the beam. On both sides of the key 92 the beam 88 is provided with a surface 94 which serves as a support surface for the traverse mechanism 50 by cooperating with the surface 60 on the support.

The traverse mechanism 50 must be inserted into the working zone from a position at the front face of the machine, and this can only be carried out when the door assembly 32 has been swung to its open position (not shown). The rear end portion (FIG. 4) of the traverse mechanism is then laid on the front end of the beam 88 with the key 92 of the beam projecting into the groove 58 of the support 52. The mechanism 50 is then moved in its own longitudinal direction towards the housing of the machine while the surface 60 rests on the top face of the beam 88. The key 92 and the groove 58 form a sliding guide which ensures correct positioning of the mechanism 50 in the direction radial to the roller 18 during this movement. In general the surface 94 and the key 92 form a slide for the traverse mechanism during its insertion.

The movement of the mechanism 50 is continued until the end face 96 (FIG. 4) at the rear end of the support 52 engages the front wall of the non-illustrated housing. The clutch element 29 engages with a corresponding clutch element (not shown) on a drive shaft of a motor mounted (not shown) on the rear face of the front wall of the housing. The two coupling parts together form an automatically engagable clutch by which drive forces can be transmitted from the motor to the rotary shaft 27 of the traverse mechanism. Clutches of the BO-Wex types supplied by Kupplungstechnik Gmbh of Rheine, BRD are suitable.

Before the end face 96 engages the front wall of the housing, the connector elements 72,74 couple with corresponding connector elements on the front wall of the housing so that pressure air from a source (not shown) in the housing can be fed to the unit 62 (FIG. 2).

During the final phase of the insertion, the pin 86 (FIG. 3) contacts the front face of the part 30 and is pressed downwardly against the bias of the non-illustrated torsion spring so that it does not hinder insertion. When the end face 96 engages the front wall of the housing, the outer end of the pin 86 is received in an opening in an element 98 (FIG. 1 and 3) fixed to the machine frame. While the pin 86 remains connected with the element 98 the tranverse mechanism 50 can not be moved along the slideway.

After insertion of the mechanism 50, the door assembly 32 is swung back into its closed position. In this condition, the edge portion of the frame 38 on the right hand side of the assembly (as seen in FIG. 1) overlaps the left edge portion of the extension 72 (FIG. 3). This overlap is also indicated schematically in FIG. 2 by the lines 100 which represent the position of the door rim relative to the carrier 52. While the door assembly 32 stays in its closed position, therefore, the traverse mechanism 50 cannot be removed from the machine, regardless of whether the knob 82 is operated to release the locking device 76. As described in detail in U.S. Ser. No. 941,418, the door assembly 32 can only be pivoted out of its closed position when the machine is in a predetermined, safe condition. Whenever the machine is ready for operation, the mechanism 50 must stay in its operating position.

The element 98 (FIG. 1) can also be provided with a feeler (not shown) to react to the condition of the locking pin 86. If the device 76 is unlocked by operation of the knob 82 the feeler emits a signal to prevent normal operation of the machine. The machine can therefore only be set in normal operation if a traverse mechanism 50 has been correctly inserted.

The surface 94 on the beam 88 serves as a support surface for the carrier 52 which therefore no longer has to be cantilever mounted from one end. The surface (FIG. 2) within the groove 58 directed towards the roller 18 serves as an abutment surface engaging a corresponding surface on the key (FIG. 1) and hence defines the position of the carrier 52 in the radial direction relative to the roller 18 (at right angles to the threadline); this location effect is obtained over the whole length of the carrier and the roller. The end face 96 (FIG. 4) also serves as an abutment surface engaging the machine housing to define the position of the fully inserted mechanism 50 in the longitudinal direction.

It can also prove advantageous to press the fully inserted mechanism 50 against its support surface 94 so that its position is firmly defined in the vertical direction as well. A suitable device for this purpose comprises a piston-and-cylinder unit 67 (dotted lines, FIG. 2), operable from outside the machine and secured to the machine frame 69. After the mechanism 50 has been located in its operating position, the unit 67 can be pressurised to force the piston rod 65 downwardly. The rod then engages a pedestal 63 mounted on top of the housing 52. A plurality of such securing devices can be provided.

FURTHER MODIFICATIONS

The invention is not limited to the illustrated embodiments. It is advantageous to provide a guide means to guide the mechanism during insertion, and also means to define the position of the fully inserted mechanism relative to the threadline 28 (or the roller 18). In the illustrated embodiment these functions are both performed in part by the key 92, but they can be performed by separate parts. The mechanism should in any event be guided into the predetermined position.

A support surface to support the mechanism in its operating position is also an advantage. In the illustrated embodiment, this surface 94 is arranged immediately next to the guide key 92, but this is not absolutely necessary. The support surface also does not have to be arranged underneath the mechanism, which could for example be suspended from a rail or be supported by a rail secured to the side wall 14.

It is also not essential to provide the support surface and the guide over the whole length of the mechanism, which must however be firmly guided throughout insertion and securely carried in its operating position. The mechanism should also not be able to bend in the operating position.

The invention is not limited to the use of traverse devices with grooved rollers. Other types have been mentioned in the introduction to this specification, and still further types are usable with this invention. Where the traverse mechanism itself does not include a drive source, which will normally be the case for reasons of space, the mechanism can be provided with an automatically engageable coupling (clutch), although the invention is not limited to the illustrated clutch type. A magnetic clutch could be used. The word "automatic" does not imply in this context that the cooperation between the clutch parts becomes effective simply due to the insertion movement. A separate operation to effect engagement of the clutch elements could be required, but the operating elements must then be provided at the front end of the mechanism.

The invention is also not limited to use in the illustrated machine. It can also be applied advantageously in a machine with only a single chuck, e.g. in an installation in accordance with the previously mentioned GB Patent. It clearly gives the greatest advantage where the mechanism must be inserted from the front of the working zone because the long sides of the working zone are inaccessible or difficult of acess.

Overlapping of the mechanism by the front door is of course not essential to the invention. Where the mechanism is not to be removable from the machine util after unlocking of the front door, a separate locking device can be provided for the mechanism and can be interlocked with the lock 104 (FIG. 1) for the front door.

Were the machine layout permits, the guide and support functions for the mechanism can be performed by a single element secured to the machine frame, e.g. a guide rod on the machine can cooperate with a tube on the mechanism.

The mechanism can also comprise additional elements, e.g. a wheel 105 (dotted lines, FIG. 4), rotating with the shaft 27 and cooperating in operation with a sensor 103 mounted in the machine to generate a signal dependent upon the speed of rotation or angular position of the shaft 27.

What is claimed is:

1. In combination, a winder having a contact roll and a support surface extending in parallel to said roll and supported at at least two longitudinally spaced apart points;

an elongated carrier having means extending along the length thereof for slidable mounting on said support surface in said winder along an axis parallel to said contact roll in said winder;

at least one thread guide mounted on said carrier;

drive elements extending within said carrier for driving said guide;

said means on said carrier being disposed to interengage with said support surface during assembly to support said carrier at least at two end positions spaced in the longitudinal direction to prevent bending of said carrier between said end ppositions, to position said carrier in a predetermined operating position parallel to said contact roll and to longitudinally guide said carrier during assembly into and removal from said winder.

2. The combination according to claim 1 characterized in that said means is a support surface extending in the longitudinal direction of said carrier to cooperate with said support surface in said winder.

3. The combination according to claim 1 characterized in that said carrier is provided with at least one abutment surface to cooperate with an abutment in said winder to define the position of said carrier relative to a thread line in said winder.

4. The combination according to claim 3 characterized in that said carrier is provided with at least two abutment surfaces, one of which defines the position of said carrier in the longitudinal direction and the other in at least one transverse direction in cooperation with corresponding abutments in said winder.

5. The combination according to claim 1 characterized in that said drive elements comprise a part of an automatically engageable clutch, which can be brought into operable condition before or after fully insertion of said carrier without manipulation of said clutch itself.

6. The combination according to claim 1 characterized in that a locking device is provided to hold said carrier in an operating position by cooperation with a part provided in said winder.

7. The combination as set forth in claim 1 wherein said means is disposed on an underside of said carrier.

8. The combination as set forth in claim 7 wherein said means includes a longitudinal groove in said underside and an outwardly facing surface on each side of said groove on said underside.

9. In combination a winder having a contact roll for winding of at least one thread onto a chuck and a support surface parallel to said contact roll and supported at at least two longitudinally spaced apart points; and a traverse mechanism including a carrier slidably engaging said support surface of said winder in parallel to said contact roll and supported at opposite ends thereof on at least two spaced apart locations of said support surface, said mechanism including at least one thread guide mounted in said carrier in facing relation to said contact roll.

10. The combination as set forth in claim 9 wherein said winder includes a longitudinally extending beam parallel to said contact roll defining said support surface and having a longitudinally extending key therein and said carrier includes a longitudinally disposed groove slidably receiving said key.

11. The combination as set forth in claim 9 wherein said winder includes an enclosure enclosing said contact roll and said traverse mechanism and a door in a front wall of said enclosure, said door being disposed in a plane of said carrier to prevent longitudinal movement of said carrier from said enclosure.

12. The combination as set forth in claim 9 wherein said traverse mechanism includes a first clutch part at one end for engaging a cooperating second clutch part in said winder and drive elements connected to said first clutch part for driving said traverse device.

13. The combination as set forth in claim 9 which further comprises a locking device at one end of said carrier for releasably locking said carrier in said winder.

14. The combination as set forth in claim 9 wherein said traverse mechanism includes a grooved roll having said thread guide mounted thereon.

15. A traverse mechanism for assembly in a winder comprising:

an elongated carrier having at least one thread guide therein for longitudinal movement thereon;

a drive shaft rotatably mounted at opposite ends thereof in said carrier and having means at one end for engaging with a drive means;

a grooved roll mounted concentrically on said drive shaft for rotation therewith to reciprocate said thread guide; and a lock mounted on an opposite outer end of said carrier from said one end of said drive shaft for releasably engaging with the winder thereat to lock said carrier in place after sliding longitudinally into the winder.

16. A traverse mechanism as set forth in claim 15 wherein said carrier has a longitudinal groove for slidably receiving a key on a winder during sliding into and out of the winder.

17. A traverse mechanism as set forth in claim 15 wherein said means on said drive shaft is a clutch element for engaging with a drive shaft of a motor.

18. A traverse mechanism as set forth in claim 15 wherein said carrier has a grip at said outer end.

19. In combination a winder having an enclosure including a side wall, a front wall having an opening therein, and a contact roll in said enclosure for winding of at least one thread onto a chuck;

an elongated carrier having at least one thread guide disposed for movement along a linear path parallel to said contact roll; and guide means supported at at least two longitudinally spaced apart points in said enclosure for guiding said carrier through said opening into and out of said winder parallel to said contact roll.

20. The combination as set forth in claim 19 wherein said guide means includes a beam extending along said side wall of said housing from said front wall parallel to said contact roll.

21. The combination as set forth in claim 20 wherein said beam includes a longitudinally disposed key and said carrier includes a groove on an underside of said carrier slidably receiving said key.

22. The combination as set forth in claim 20 wherein said beam includes a support surface for slidably receiving and supporting said carrier thereon.

23. The combination as set forth in claim 19 which further comprises a door on said winder for at least partially closing over said opening.

* * * * *

UNITED STATES PATENT AND TRADEMARK OFFICE

CERTIFICATE OF CORRECTION

PATENT NO. : 5,048,769

DATED : Sept. 17, 1991

INVENTOR(S) : ARMIN WIRZ, et al

It is certified that error appears in the above-identified patent and that said Letters Patent is hereby corrected as shown below:

Column 6, line 39 "tranverse" should be -traverse-
Column 7, line 67 after "Patent" insert -1304609-
Column 8, line 5 "util" should be -until-
Column 8, line 36, "ppositions," should be --positions,--.

Signed and Sealed this

Twentieth Day of April, 1993

*Attest:*

MICHAEL K. KIRK

*Attesting Officer*

*Acting Commissioner of Patents and Trademarks*